US006435062B1

(12) United States Patent
McCann

(10) Patent No.: US 6,435,062 B1
(45) Date of Patent: Aug. 20, 2002

(54) RATCHET WRENCH HAVING EASILY ASSEMBLING STRUCTURE

(75) Inventor: Frank McCann, Taichung Hsien (TW)

(73) Assignee: The Stanley Works, New Britain, CT (US)

( * ) Notice: Subject to any disclaimer, the term of this patent is extended or adjusted under 35 U.S.C. 154(b) by 0 days.

(21) Appl. No.: 09/898,839

(22) Filed: Jul. 5, 2001

(51) Int. Cl.[7] ..... B25B 13/46
(52) U.S. Cl. ..... 81/63; 81/60; 81/63.2
(58) Field of Search ..... 81/60, 61, 62, 81/63, 63.1, 63.2

(56) References Cited

U.S. PATENT DOCUMENTS 3,019,682 A * 2/1962 Hare ..... 81/63.2
5,533,427 A * 7/1996 Chow ..... 81/63.2
5,957,009 A 9/1999 McCann ..... 81/63.2
5,974,915 A * 11/1999 Chou ..... 81/63.1
6,260,449 B1 * 7/2001 I-He ..... 81/63.2
6,279,428 B1 * 8/2001 Huang ..... 81/63.1
6,282,991 B1 * 9/2001 Hu ..... 81/63.2

* cited by examiner

*Primary Examiner*—Eileen P. Morgan
*Assistant Examiner*—Joni B. Danganan
(74) *Attorney, Agent, or Firm*—Pillsbury Winthrop LLP

(57) ABSTRACT

A wrench includes a driving head having an opening and a chamber and a cavity for receiving a gear and a pawl and an actuator. The actuator is coupled to the pawl with a spring for moving the pawl to control the operating direction of the gear. A spring blade is received in the cavity of the driving head and includes a projection engaged with the actuator for positioning the actuator to the driving head. The driving head has one or more cusps for engaging with the spring blade and for preventing the spring blade from rotating relative to the driving head.

7 Claims, 4 Drawing Sheets

RATCHET WRENCH HAVING EASILY ASSEMBLING STRUCTURE

BACKGROUND OF THE INVENTION

1. Field of the Invention

The present invention relates to a wrench, and more particularly to a ratchet wrench having a structure for allowing the ratchet wrench to be easily assembled.

2. Description of the Prior Art

Various kinds of typical ratchet wrenches have been developed and used today. U.S. Pat. No. 5,957,009 to the present applicant, McCann, discloses one of the typical ratchet wrenches including a structure that may not be easily assembled. For example, an actuator and a pawl and a spring and a gear are required to be depressed and retained in place in the driving head by the workers before the cover may be engaged onto and secured onto the driving head. In addition, the spring-biased projection may not be easily engaged into or assembled into the actuator which should include a great thickness for allowing a cavity to be formed in the actuator and for allowing the spring-biased projection to be engaged into the cavity of the actuator. The spring-biased projection is also required to be depressed and retained in place in the actuator by the workers before the cover is engaged onto and secured onto the driving head.

The present invention has arisen to mitigate and/or obviate the afore-described disadvantages of the conventional ratchet wrenches.

SUMMARY OF THE INVENTION

The primary objective of the present invention is to provide a ratchet wrench including a structure for allowing the ratchet wrench to be easily assembled.

In accordance with one aspect of the invention, there is provided a wrench comprising a driving head including an opening and a chamber and a cavity formed therein and communicating with each other, the chamber of the driving head including two ends, a gear rotatably received in the opening of the driving head, an actuator rotatably received in the cavity of the driving head, a pawl slidably received in the chamber of the driving head and movable between the ends of the chamber of the driving head, the actuator including means for moving the pawl between the ends of the chamber of the driving head, and a spring member received in the cavity of the driving head and including a projection extended therefrom for engaging with the actuator and for positioning the actuator to the driving head.

The driving head includes at least one cusp extended between the chamber and the cavity thereof, the spring member is a spring blade and includes at least one notch formed therein for receiving the cusp of the driving head and for retaining the spring blade to the driving head and for preventing the spring blade from rotating relative to the driving head.

The spring blade includes at least one leg extended therefrom and having the notch formed therein for receiving the cusp of the driving head.

The moving means of the actuator includes a spring element coupled between the actuator and the pawl for moving the pawl between the ends of the chamber of the driving head.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
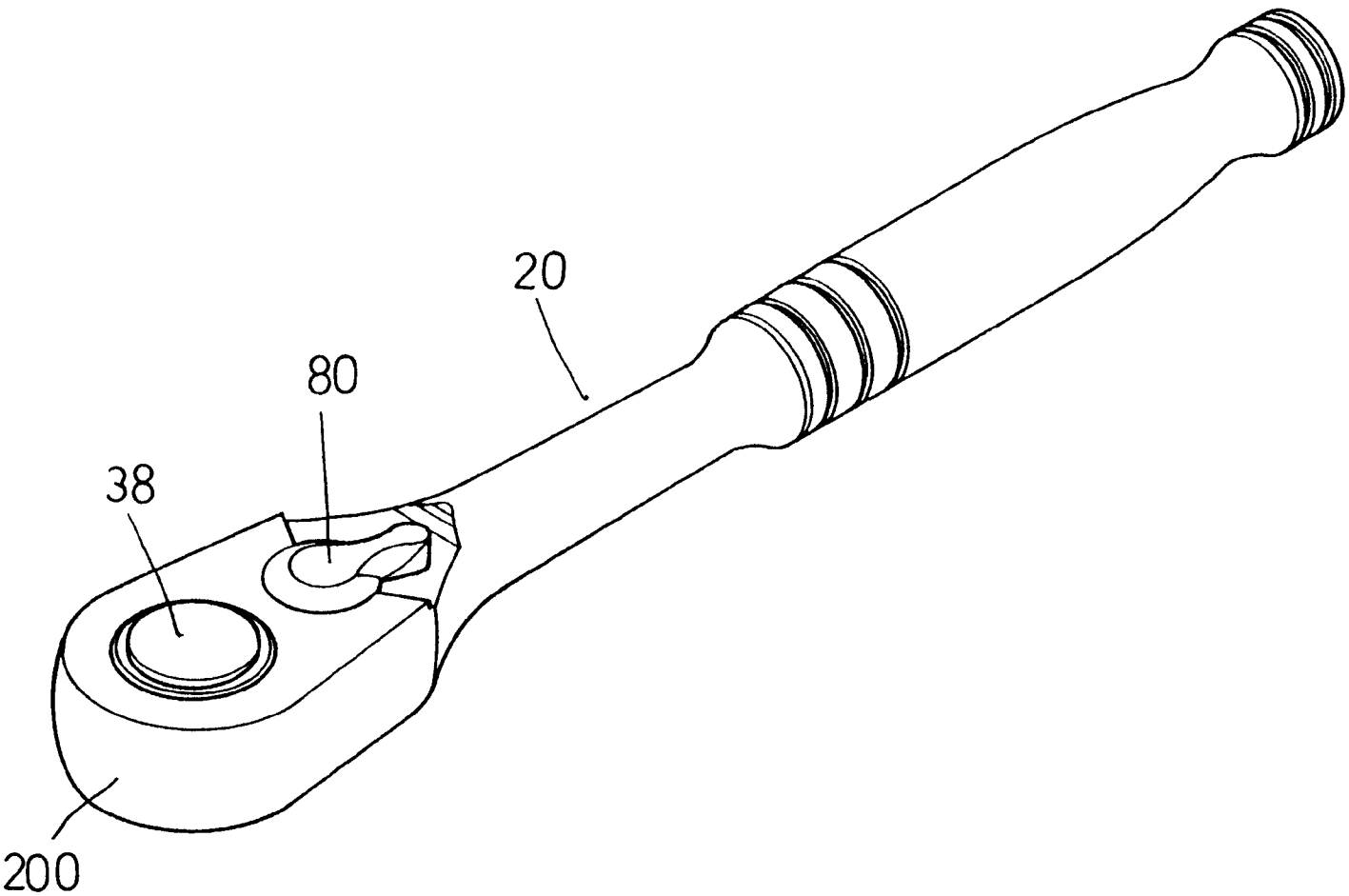
FIG. 1 is a perspective view of a ratchet wrench in accordance with the present invention.
Figure 2:
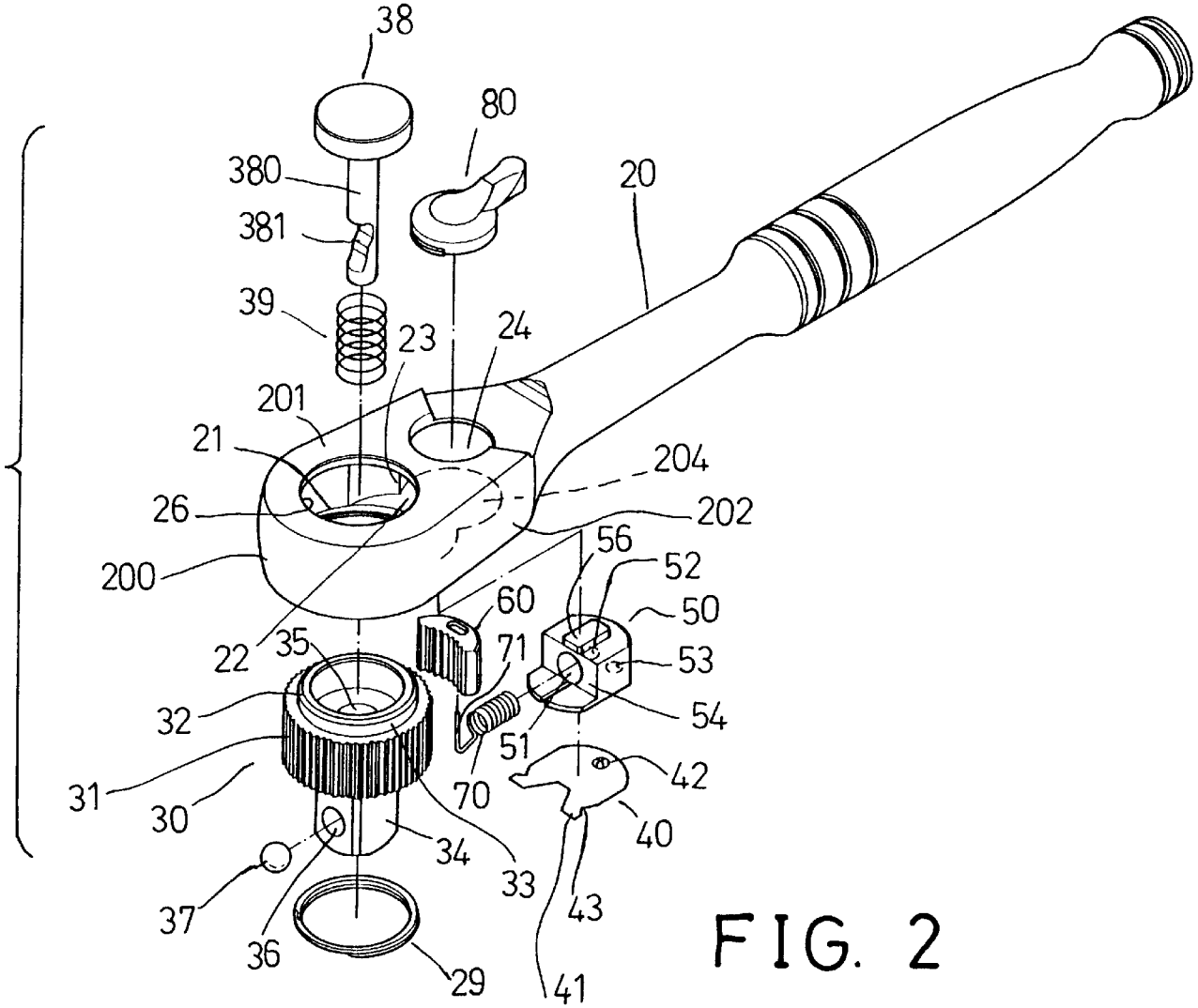
FIG. 2 is an exploded view of the ratchet wrench.
Figure 3:
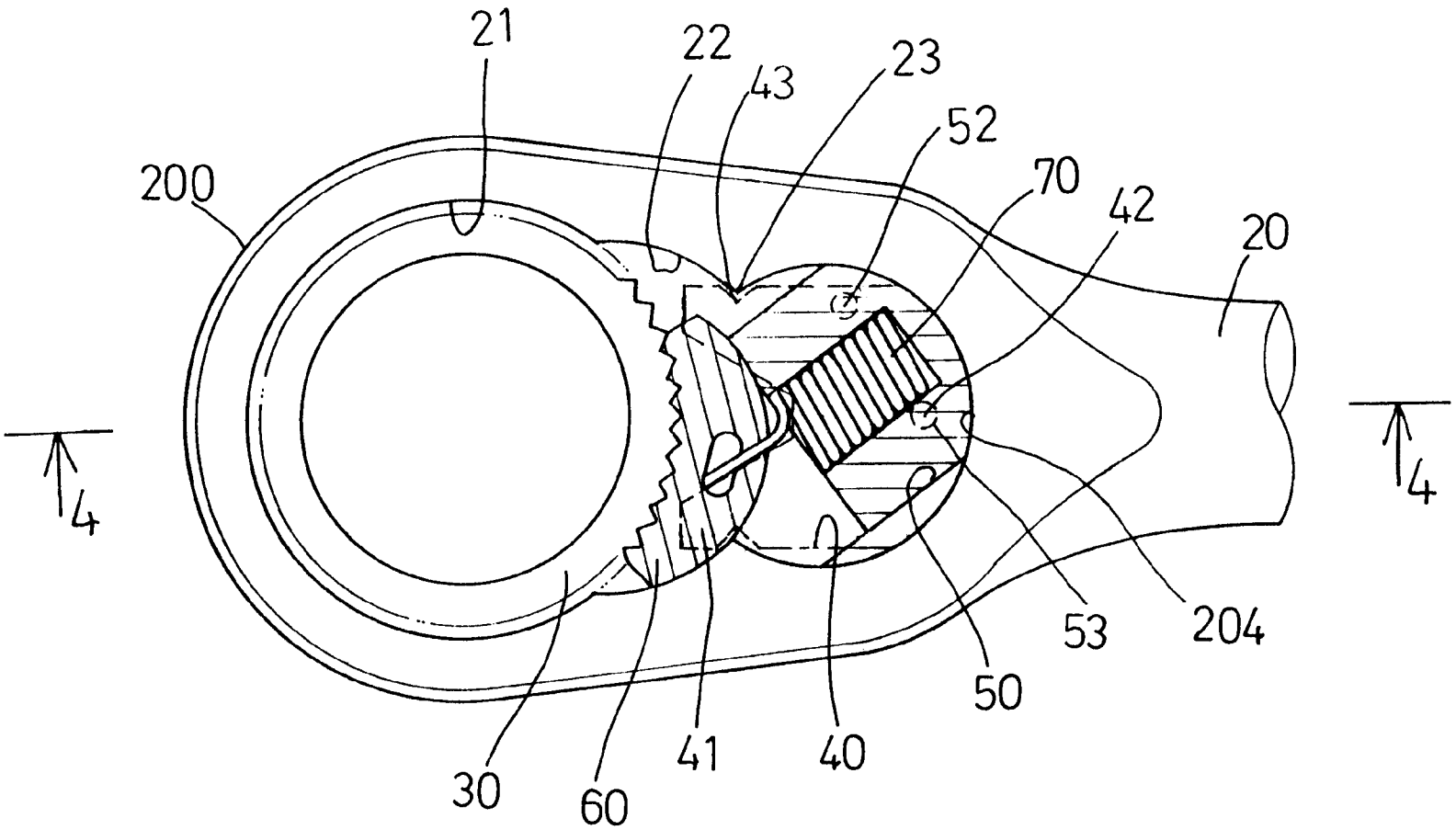
FIG. 3 is a top plane schematic view of the ratchet wrench.

Referring to the drawings, a ratchet wrench in accordance with the present invention comprises a handle 20 including a driving head 200 formed and provided on one end thereof and having an opening 21 and a chamber 22 and a cavity 204 formed therein and intersecting with each other or communicating with each other, and defined between an upper wall 201 and a bottom wall 202. The cavity 204 and the chamber 22 of the driving head 200 are circular having one or more cusps 23 formed between the cavity 204 and the chamber 22 of the driving head 200 (FIGS. 2, 3). The upper wall 201 of the driving head 200 includes an aperture 24 and an orifice 26 formed therein and communicating with the cavity 204 and the opening 21 of the driving head 200 respectively, and having an inner diameter smaller than that of the cavity 204 and of the opening 21 of the head 200 respectively for forming or defining an annular or a peripheral flange 27 (FIG. 4) around the opening 21 and the cavity 204 of the driving head 200 respectively. A peripheral groove 28 is formed in the bottom portion of the head 200 and communicating with the opening 21 of the head 200 for receiving a clamping ring or a retaining ring 29.

A gear 30 is rotatably received and retained in the opening 21 of the head 200 by the retaining ring 29. and includes a number of teeth 31 formed on the outer peripheral portion thereof and includes a barrel 32 extended upward therefrom and having an outer diameter smaller than that of the gear 30 for defining a peripheral shoulder 33 therein. The peripheral shoulder 33 of the gear 30 is rotatably engaged with the peripheral flange 27 of the driving head 200. The gear 30 includes a driving stem 34 extended downward therefrom for engaging with and for driving the fasteners directly or with the tool bits or the tool extensions or the like. and includes a cavity 35 formed therein for slidably receiving a rod 380 of a button 38. and includes a hole 36 formed in the driving stem 34 and communicating with the cavity 35 of the gear 30 for receiving a ball 37. The rod 380 includes a recess 381 formed therein for receiving the ball 37. A spring 39 is engaged between the gear 30 and the button 38 for biasing the rod 380 to actuate the ball 37 outward of the driving stem 34 and to secure the tool bit or the tool extension to the driving stem 34.

An actuator 50 is rotatably received in the cavity 204 of the driving head 200, and includes an aperture 51 formed therein for receiving a spring or a spring element 70, and includes two depressions 52, 53 formed in the bottom portion thereof, and includes a cut-off portion or a notch 54 formed in the front portion thereof and communicating with the aperture 51 thereof, and includes a protrusion 56 extended upward therefrom. A knob 80 is engaged with or secured to the protrusion 56 of the actuator 50 via the aperture 24 of the driving head 200 for rotating the actuator 50 relative to the head 200. A pawl 60 is slidably received in the chamber 22 of the driving head 200 and movable between the ends of the chamber 22 of the driving head 200.

The spring 70 includes an extension 71 engaged into the pawl 60 for moving the pawl 60 between the ends of the chamber 22 of the driving head 200.

A spring member 40, such as a spring blade 40, is preferably made of resilient materials, such as the steel or plastic or rubber materials, and is engaged in the cavity 204 of the driving head 200, and includes one or more legs 41 extended inward of the chamber 22 of the driving head 200 and includes one or more notches 43 formed in the side portions thereof or formed in the legs 41 thereof for receiving the cusps 23 of the driving head 200 and for retaining or securing the spring member 40 to the driving head 200 and for preventing the spring member 40 from rotating relative to the driving head 200. The spring member 40 includes a projection 42 extended therefrom and formed as a spring-biased projection 42 by the resilience or the spring-characteristic of the spring member 40 for engaging with either of the depressions 52, 53 of the actuator 50 (FIG. 4) and for retaining or positioning the actuator 50 to the driving head 200 at a suitable angular position relative to the driving head 200.

Figure 4:
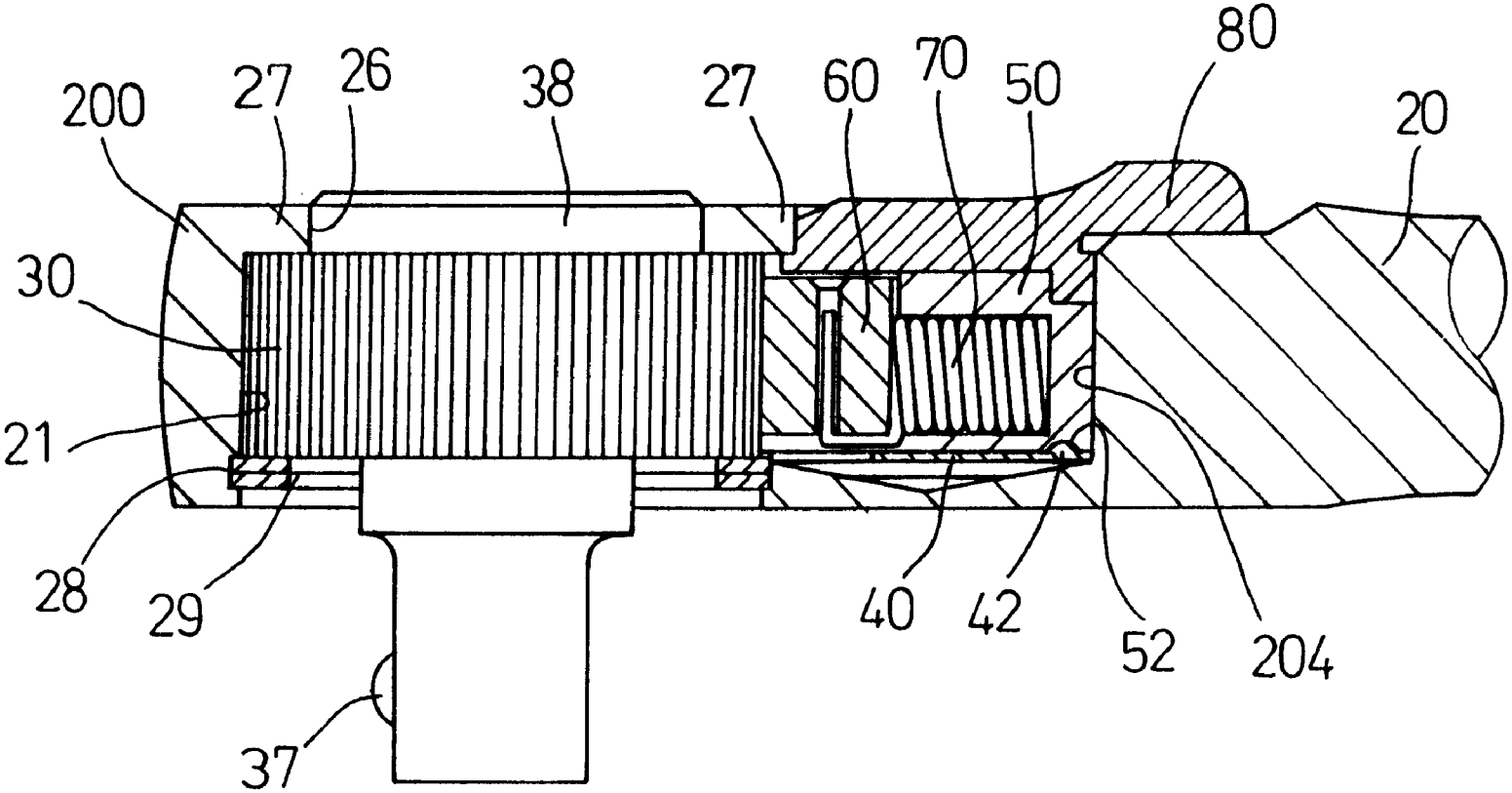
FIG. 4 is a cross sectional view taken along lines 4—4 of FIG. 3.

In operation. as shown in FIGS. 3 and 4. the pawl 60 may be moved to either of the ends of the chamber 22 of the head 200 in order to control the rotational movement of the gear 30 relative to the head 200. The engagement of the pawl 60 with the gear 30 and the driving operation of the driving head 200 relative to the gear 30 has been disclosed and described in the U.S. Pat. No. 5.957.009 to McCann, which is taken as a reference for the present invention.

As shown in FIG. 4, when assembling the ratchet wrench, the spring member 40 and the actuator 50 and the spring 70 and the pawl 60 may be easily and quickly engaged into the cavity 204 and the chamber 22 of the driving head 200 and may be easily and directly retained in the cavity 204 and the chamber 22 of the driving head 200 by the upper wall 201 and the bottom wall 202 of the driving head 200 without any further or additional fasteners. The gear 30 may then be easily and quickly engaged into the opening 21 of the driving head 200 and secured to the driving head 200 with the retaining ring 29.

It is to be noted that the spring member 40 may be retained or secured to the driving head 200 by engaging the cusps 23 of the driving head 200 into the notches 43 of the spring member 40. It is only required to form the depressions 52, 53 of the actuator 50 for receiving the spring biased projection 42, such that the actuator 50 may be easily manufactured and assembled. The spring biased projection 42 may also be easily formed on the spring member 40 and may be easily engaged into either of the depressions 52, 53 of the actuator 50, such that the actuator 50 and the spring member 40 may also be easily manufactured and assembled into the cavity 204 of the driving head 200.

Accordingly, the ratchet wrench in accordance with the present invention includes a structure for allowing the ratchet wrench to be easily assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench comprising:

a driving head including an opening and a chamber and a cavity formed therein and communicating with each other, said chamber of said driving head including two ends, said driving head including at least one cusp extended between said chamber and said cavity thereof, a gear rotatably received in said opening of said driving head, an actuator rotatably received in said cavity of said driving head, a pawl slidably received in said chamber of said driving head and movable between said ends of said chamber of said driving head, said actuator including means for moving said pawl between said ends of said chamber of said driving head, and a spring member received in said cavity of said driving head and including a projection extended therefrom for engaging with said actuator and for positioning said actuator to said driving head, said spring member being a spring blade and including at least one notch formed therein for receiving said at least one cusp of said driving head and for retaining said spring blade to said driving head and for preventing said spring blade from rotating relative to said driving head.

2. A wrench according to claim 1, wherein said spring blade includes at least one leg extended therefrom and having said at least one notch formed therein for receiving said at least one cusp of said driving head.

3. A wrench according to claim 1, wherein said moving means of said actuator includes a spring element coupled between said actuator and said pawl for moving said pawl between said ends of said chamber of said driving head.

4. A wrench comprising:

a driving head including an opening and a chamber and a cavity formed therein and communicating with each other, and including an upper wall and a bottom wall for defining said opening and said chamber and said cavity between said upper wall and said bottom wall, said chamber of said driving head including two ends, a gear rotatably received in said opening of said driving head, an actuator rotatably received in said cavity of said driving head, a pawl slidably received in said chamber of said driving head and movable between said ends of said chamber of said driving head, said actuator including means for moving said pawl between said ends of said chamber of said driving head, and a spring blade received in said cavity of said driving head and engaged with said bottom wall of said driving head, and including a projection extended therefrom for engaging with said actuator and for positioning said actuator to said driving head.

5. A wrench according to claim 4, wherein said driving head includes at least one cusp extended between said chamber and said cavity thereof, said spring blade includes at least one notch formed therein for receiving said at least one cusp of said driving head and for retaining said spring blade to said driving head and for preventing said spring blade from rotating relative to said driving head.

6. A wrench according to claim 5, wherein said spring blade includes at least one leg extended therefrom and having said at least one notch formed therein for receiving said at least one cusp of said driving head.

7. A wrench according to claim 4, wherein said moving means of said actuator includes a spring element coupled between said actuator and said pawl for moving said pawl between said ends of said chamber of said driving head.

* * * * *